US006823562B1

(12) United States Patent
Smith et al.

(10) Patent No.: US 6,823,562 B1
(45) Date of Patent: Nov. 30, 2004

(54) GRIP ASSEMBLY ATTACHABLE TO VARIOUSLY SHAPED ARTICLES

(76) Inventors: Robert Tyson Smith, 4220 E. Main St., #E-38, Mesa, AZ (US) 85205; Ethel Catharine Smith, 4220 E. Main St., #E-38, Mesa, AZ (US) 85205

( * ) Notice: Subject to any disclaimer, the term of this patent is extended or adjusted under 35 U.S.C. 154(b) by 0 days.

(21) Appl. No.: 10/138,703

(22) Filed: May 3, 2002

(51) Int. Cl.[7] ..... A45C 13/22; B25G 3/00

(52) U.S. Cl. ..... 16/421; 16/422; 16/430; 16/DIG. 12

(58) Field of Search ..... 16/421, 422, DIG. 12, 16/DIG. 18, DIG. 19, 430; 81/489, 177.1; 15/25, 26, 145; 473/537, 538, 552, 568

(56) References Cited

U.S. PATENT DOCUMENTS

| | | | | | |
|---|---|---|---|---|---|
| 2,398,436 | A | * | 4/1946 | Mason | 220/752 |
| 3,848,871 | A | * | 11/1974 | Sweet et al. | 473/549 |
| 3,913,172 | A | * | 10/1975 | Richards et al. | 16/411 |
| 4,071,063 | A | * | 1/1978 | Russell | 383/7 |
| 4,072,312 | A | * | 2/1978 | Kahn | 473/538 |
| 4,251,071 | A | * | 2/1981 | Norton | 482/125 |
| 4,438,925 | A | * | 3/1984 | Lindstrom | 473/551 |
| 4,655,449 | A | * | 4/1987 | Chamness | 473/549 |
| 4,706,598 | A | * | 11/1987 | Jeffress | 16/438 |
| 4,964,192 | A | * | 10/1990 | Marui | 16/421 |
| 4,989,870 | A | * | 2/1991 | Janes | 473/537 |
| 5,042,804 | A | * | 8/1991 | Uke et al. | 473/538 |
| 5,115,530 | A | * | 5/1992 | Distiso | 15/25 |
| 5,231,731 | A | * | 8/1993 | Jones, Jr. | 292/347 |
| 5,288,116 | A | * | 2/1994 | Donofrio | 292/336.3 |
| 5,299,475 | A | * | 4/1994 | Stroop | 81/489 |
| 5,671,926 | A | * | 9/1997 | Hagey | 473/549 |
| 5,795,254 | A | * | 8/1998 | Brown | 473/552 |
| 5,819,594 | A | * | 10/1998 | Sjovall | 74/551.9 |
| 6,401,301 | B1 | * | 6/2002 | Hung | 16/430 |

FOREIGN PATENT DOCUMENTS

| | | | | |
|---|---|---|---|---|
| DE | 3514023 | A1 | * 10/1986 | |
| EP | 291576 | A | * 11/1988 | A63B/49/08 |
| GB | 2290740 | A | * 1/1996 | |

* cited by examiner

*Primary Examiner*—Chuck Y. Mah
(74) *Attorney, Agent, or Firm*—Gregory J. Nelson

(57) ABSTRACT

The grip assembly that is attachable to or may be incorporated into variously shaped item sections with a grip portion and an item attachment structure. The grip portion has an ergonomically polygonal shaped outer surface. The item attachment structure is in force transferring relation to the ergonomically shaped outer surface and is securable to any one or a large variety of item shapes in a manner such that physical forces may be transferred between the item and the hand of a user gripping the ergonomically shaped outer surface portion.

12 Claims, 13 Drawing Sheets

GRIP ASSEMBLY ATTACHABLE TO VARIOUSLY SHAPED ARTICLES

FIELD OF THE INVENTION

The present invention relates to hand grips and more particularly to an ergonomically designed grip assembly that is attachable to variously shaped sections having a grip portion including a gripping outer surface portion defined by a plurality of planar surfaces forming a polygon in cross section. In the preferred form of one invention, the grip is octagonal in cross section. Two of the planar surfaces are of greater width than the others and are the surfaces of greater width oppositely disposed and parallel to one another. The grip includes attachment structure and securable to a section of an article so that manually applied forces may be transferred to the article by the user gripping and applying force to the ergonomically shaped outer surface portion of the grip.

BACKGROUND OF THE INVENTION

It is often necessary for a user to manually manipulate an article such as a tool. A handle is often provided on tools so the user may more easily apply force to the tool to use the article or to carry the article from one place to another place. Although even with a handle, many articles remain difficult to manipulate because the handle is not located in an appropriate position. It would be desirable, therefore, to have a grip assembly that can be attached to articles of various shapes and which grip assembly has an ergonomic outer shape which may be comfortably and securely gripped by a user to allow the user to manipulate the article in a more secure, safe and efficient manner.

SUMMARY OF THE INVENTION

It is thus an object of the invention to provide a grip assembly attachable to variously shaped articles having a grip portion including an ergonomically polygonal shaped outer surface defined by a plurality of planar surfaces. Each is connected to two adjacent planar surfaces and a number of the planar surfaces are of equal width and two are wider. The wider of the planar surfaces are oppositely positioned in planes parallel to each other. In a preferred embodiment, the grip is octagonal with six surfaces being of equal width and two being wider.

The grip assembly further includes article attachment structure in force transferring relation to the ergonomically shaped outer surface so the grip is securable to a section of an article such as a handle in a manner such that forces may be transferred to the article by the user through the ergonomically shaped outer surface portion.

It is a further object of the invention to provide a grip assembly attachable about a section of an article which includes a grip portion having an ergonomically shaped outer surface and an attachment structure formed in relation to a receiving passageway of the grip portion. The receiving passageway has an end open to receive a section of one article which is gripped.

It is still a further object of the invention to provide a grip assembly attachable about a section of an article that may be variously shaped. The grip portion may be formed by sections secured together with fasteners and having an ergonomically shaped outer surface.

The grip may be an integral one piece device or may be provided in mating sections which are joined at longitudinal engaging members such as an interlocking tongue and groove or dove tail joints. The grip may be provided as an aftermarket attachment or may be incorporated as a feature of an original equipment manufactured item.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein:

FIG. 8 is a perspective view of yet another embodiment of the two-part grip assembly in which the grip assembly tapers from one end to the other end and may be used for holding articles such as golf club handles and the like;

DETAILED DESCRIPTION OF THE DRAWINGS

Figure 1:
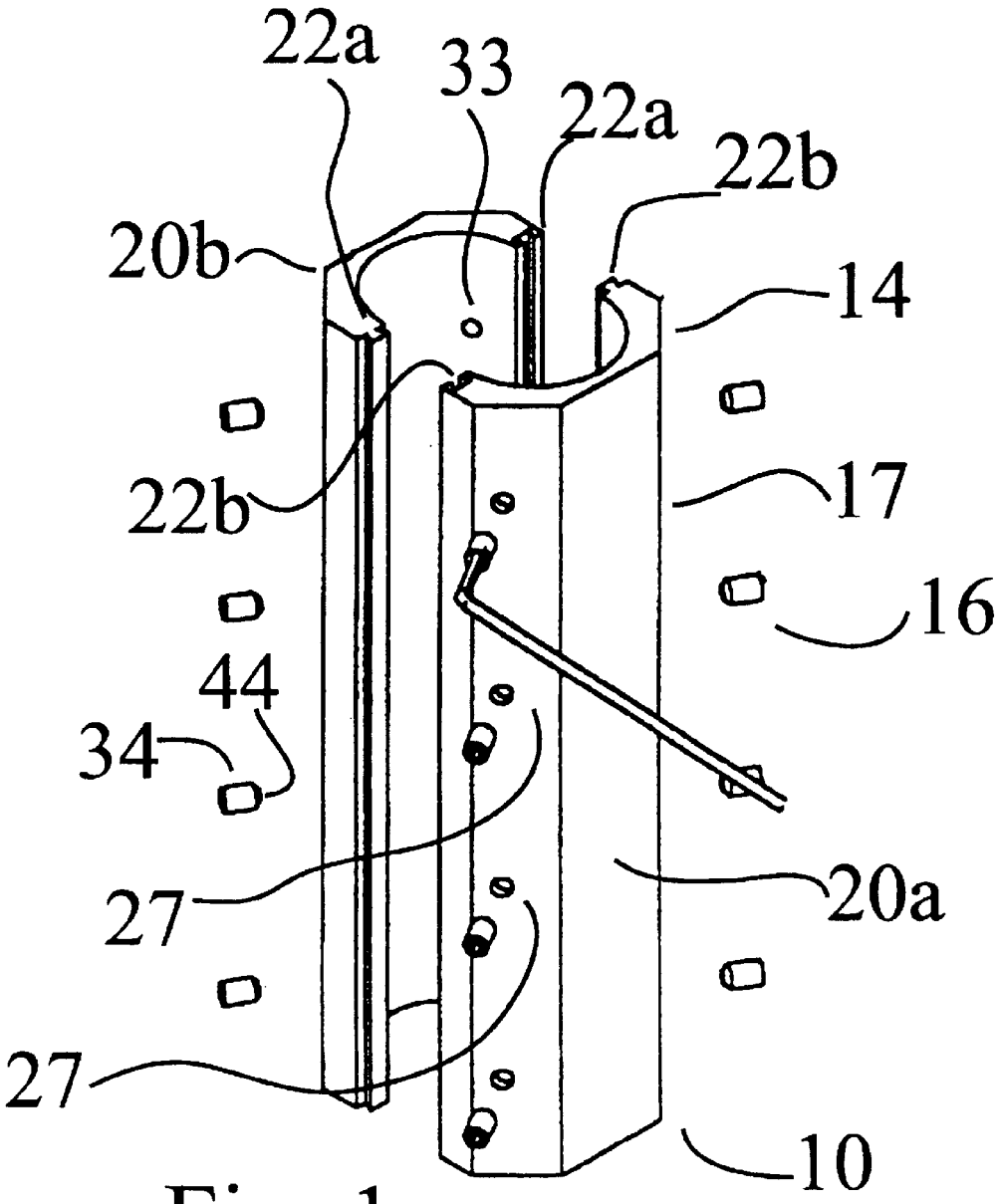
FIG. 1 is an exploded perspective view of an exemplary embodiment of the grip assembly of the present invention showing a two-part, grip portion connected at a dove tail joint and provided with an article attachment structure including an article section receiving passageway and multiple internally threaded, set screw receiving apertures provided through the sidewalls of the grip portion.

Referring to the drawings, FIGS. 1 to 11 and 13 show various embodiments of the ergonomic grip assembly attachable to variously shaped articles.

FIGS. 1–4 show a first embodiment of the ergonomic grip assembly of the present invention generally designated by one numeral 10. In this embodiment the grip assembly 10 includes an ergonomic, molded, rigid plastic, grip portion, 14, and an attachment structure, generally designated 16. The grip portion 14 includes two rigid, molded plastic grip sections 20*a*, 20*b* each having mating structures 22*a*, 22*b* along parallel, longitudinal outer edges thereof and a number of spaced apart, drilled and tapped bores 27.

Figure 2:
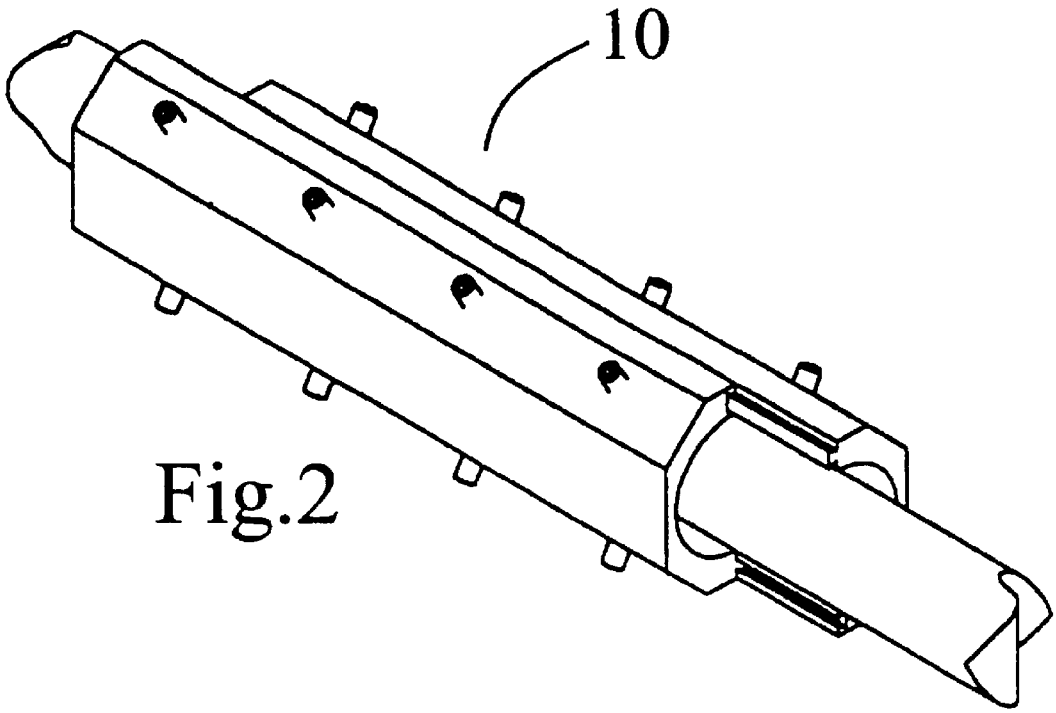
FIG. 2 is a perspective view showing the two-part, dove-tail connectable, grip portion of FIG. 1 partially engaged about a section of a handle article positioned in the article section receiving passageway of the grip.
Figure 3:
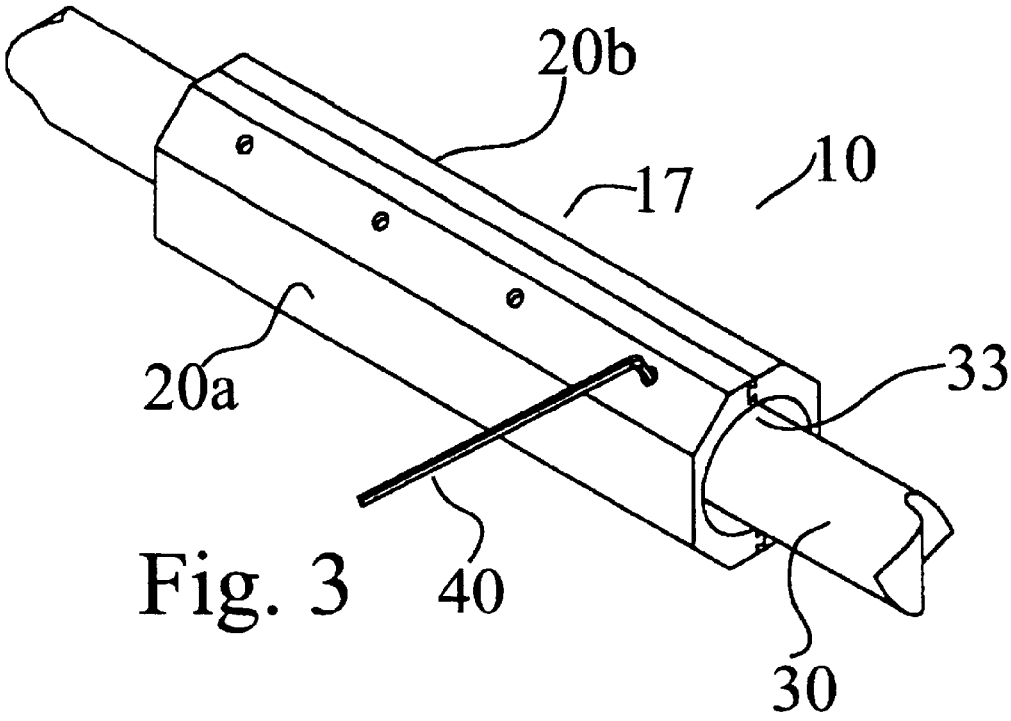
FIG. 3 is a perspective view showing a representative article handle in the grip passageway secured by set screws.

In this embodiment, mating structure 22*a* is a dove tail protrusion that is shaped and sized to slidably engage the correspondingly shaped dove tail shaped receiving slot mating structures 22*b* as shown in FIG. 2. Providing mating structures 22*a*, 22*b* on each grip portion part 20*a*, 20*b* allows a single extrusion die to be used. Once grip portion parts 20*a*, 20*b* are joined together as described and an article, such a cylinder shaped rod 30, is inserted in the receiving passageway 33 multiple hex-drive type set screws 34 are threaded into each of the set/securing screw apertures using a hex wrench 40 until the screw tip end 44 contacts the outer surface 46 of rod 30. It will typically require several rounds of adjustments to the set-securing screws 34 to secure rod 30 in passageway 33 at the desired angle and position.

Figure 4:
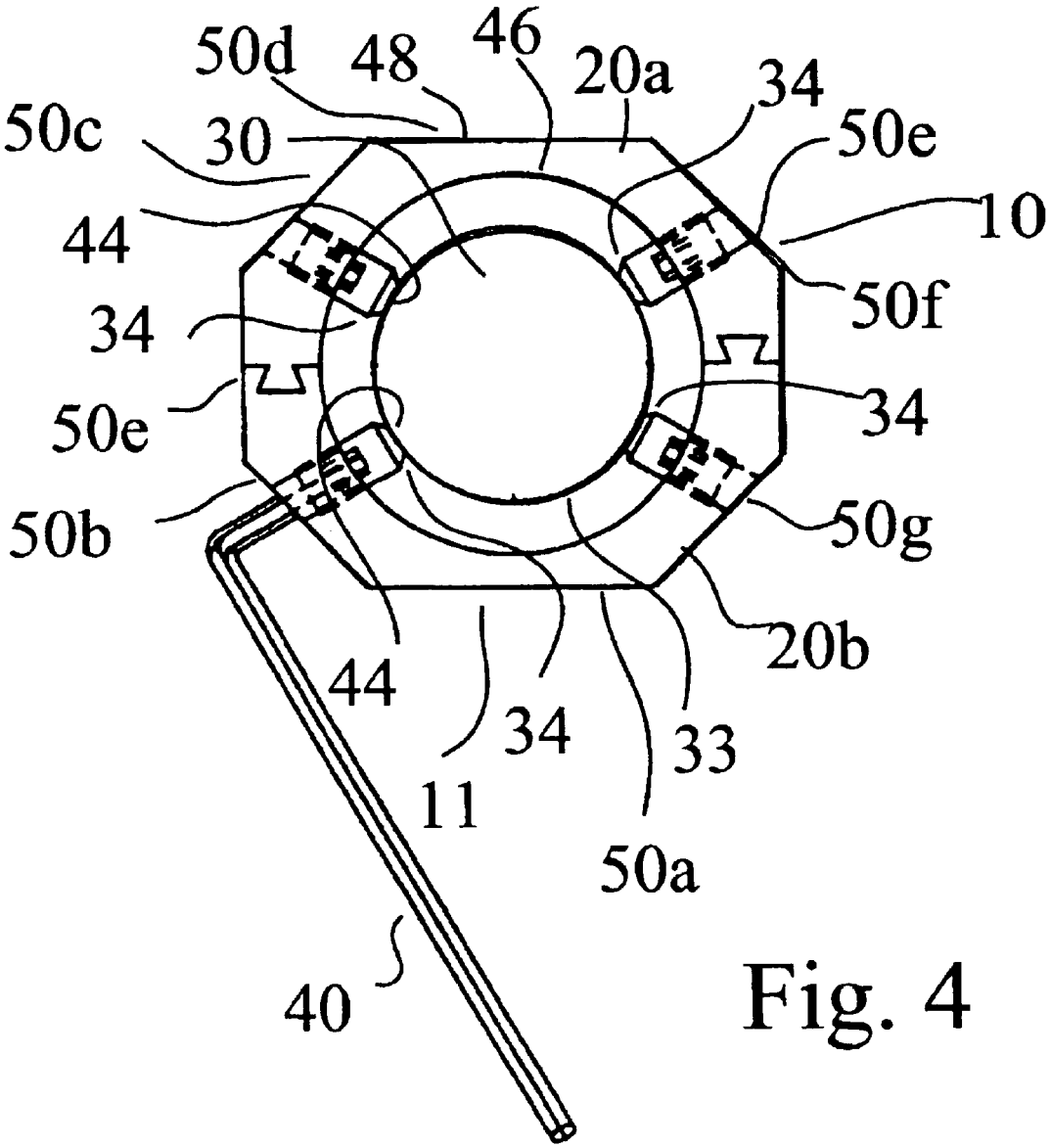
FIG. 4 is an end view showing a representative such as a tool handle within the receiving passageway of the grip showing the set screws providing a holding force against handle.
Figure 12:
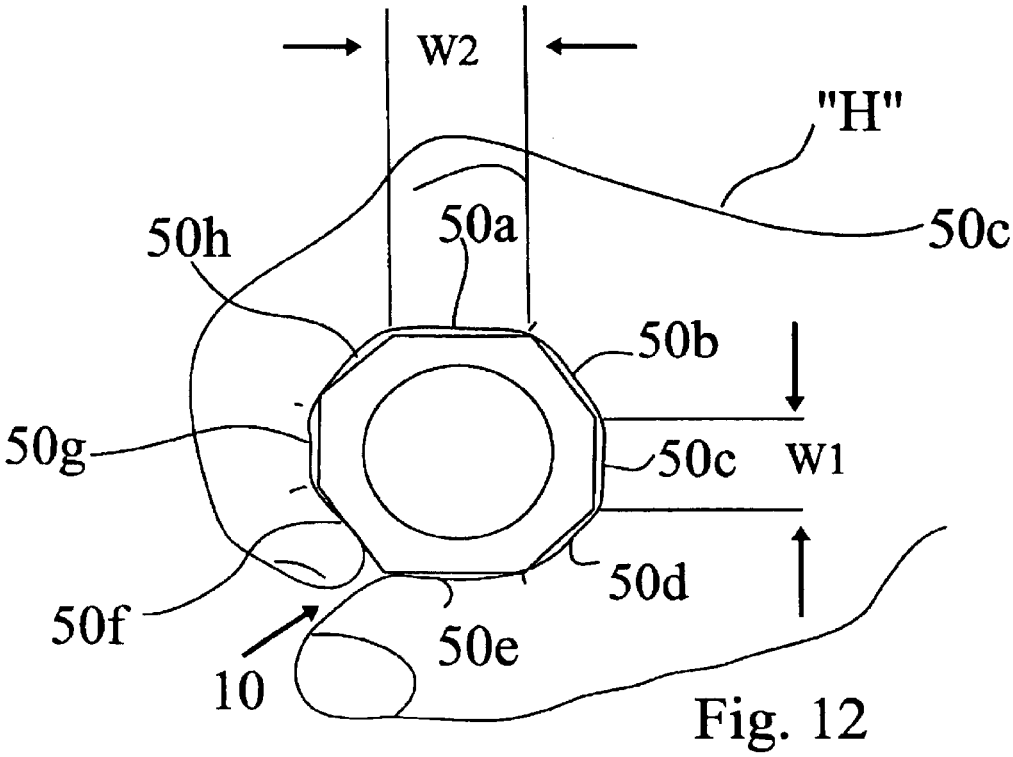
FIG. 12 illustrations the grip positioned in the hand of a user.

The grip assembly 10 is polygonal and is shown in a preferred embodiment as being octagonal with planar faces 50*a* to 50*f*. Faces 50*b*, 50*c*, 50*d*, 50*f*, 50*g* and 50*h* are of the same width W1. Faces 50*a* and 50*e* are oppositely disposed having a greater width W2 as best seen in FIG. 4 to enhance gripping in the fingers of the hand "H" of the user. This is best seen in FIG. 12.

Figure 5:
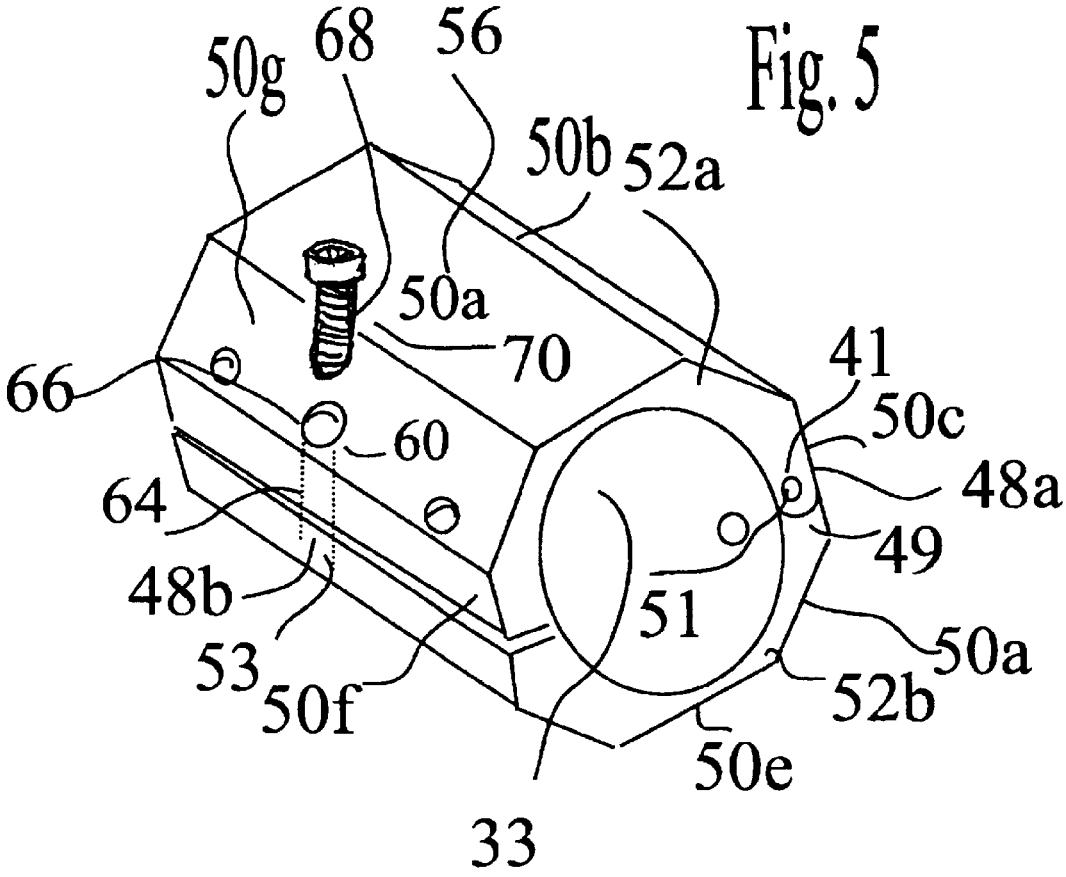
FIG. 5 is a perspective view of another embodiment in which the grip portion sections are connected along a first side by a hinge assembly and along the other side by a securing fastener.
Figure 6:
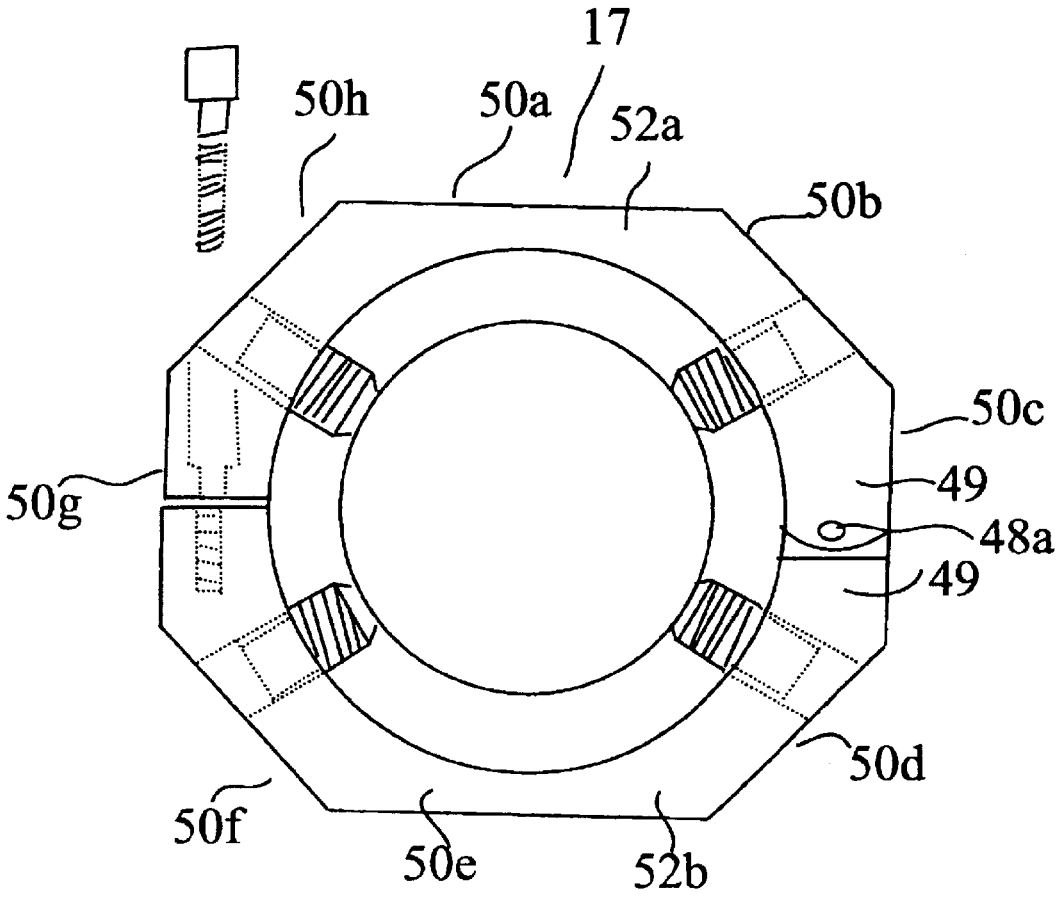
FIG. 6 is an end view of the embodiment of FIG. 5.

A second embodiment of the ergonomic grip assembly 10 of the present invention is illustrated in FIGS. 5–6. Grip portion 14*a* has the same ergonomic, outer surface with faces 50*a* to 50*f*, generally designated 17 and differs only in that the two halves 52*a*, 52*b* are machined from a material such as aluminum and joined at 48*a*, 48*b*, in place of mating structures 22*a*, 22*b* to form a passageway 33 and to hold halves 52*a*, 52*b* together against the forces generated by set/securing screws 354. In this embodiment, mechanism 48*a* includes hinge structures 49 formed along adjacent edges of halves 52*a*, 52*b*. A hinge pin 51 that pivotally connects the hinge structures 49. Mechanism 48*b* includes a drilled and tapped bore 53 formed in half 52*b*. A concentrically aligned securing screw passage 60 half 52*a* has a smaller diameter lower portion 62 and a large diameter upper portion 66, and receive securing screw 70. Upper portion 68 is larger in diameter to accommodate the head portion 68 of securing screw 70.

Figure 7:
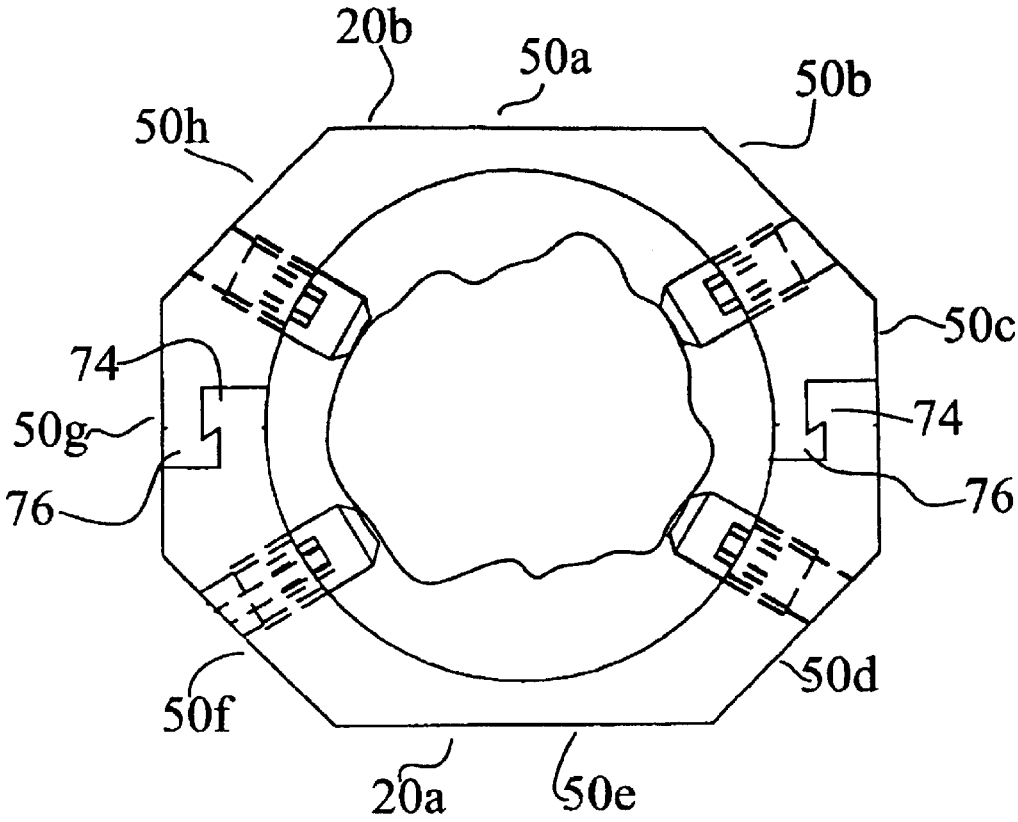
FIG. 7 shows yet another embodiment in which an irregularly shaped article is held within the passageway of a two-part, slip together grip sections which slidably engage each other along their length to secure the two grip sections together under the force generated by screws of various lengths used to secure the irregularly shaped handle item section within the item section receiving passageway.

FIG. 7 shows another embodiment of the grip 14*c* that is similar to grip portion 14 except that grip section 20*a* has inwardly extending connecting flange structures 74 and grip portion half 20*b* has two outwardly extending flange structures 76 which interconnect. The connecting structures 74, 76 are slidably engaged along the entire lengths of the two grip portion halves 20*a*, 20*b* in the same fashion as in the embodiment shown in FIGS. 1–4. Once the set screws are engaged, the force generated will tend to "lock" the sections together.

Figure 8:
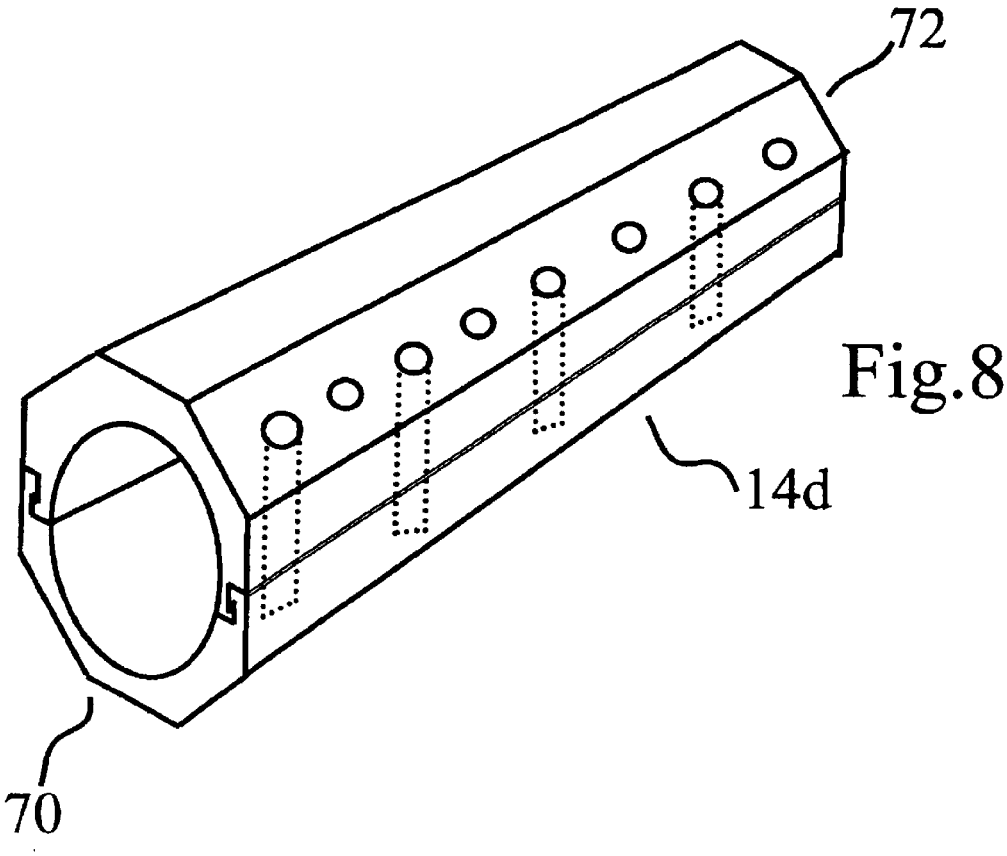

FIG. 8 shows another embodiment of the two-part grip portion 14*d* that is held together on opposite sides by screws and threaded apertures as previously described. The grip tapers from larger hexagonal shaped end 70 to a smaller hexagonal opposite end 72.

Figure 9:
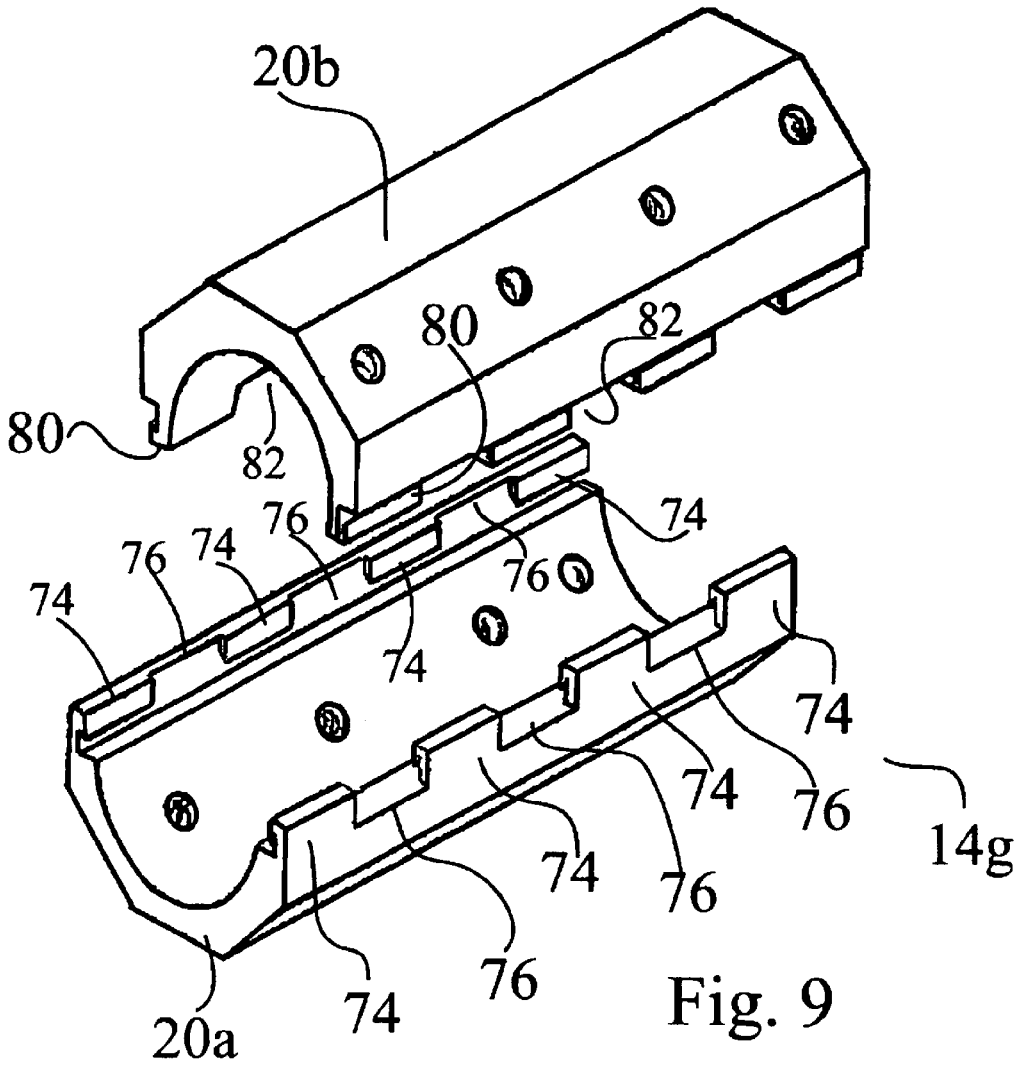
FIG. 9 is an exploded perspective view of another embodiment of the invention showing a two-part grip assembly with multiple engaging structures that allow the grip halves to be slip fit together about an article which has interfering structures at each end such as a luggage handle or a dumb bell.
Figure 10:
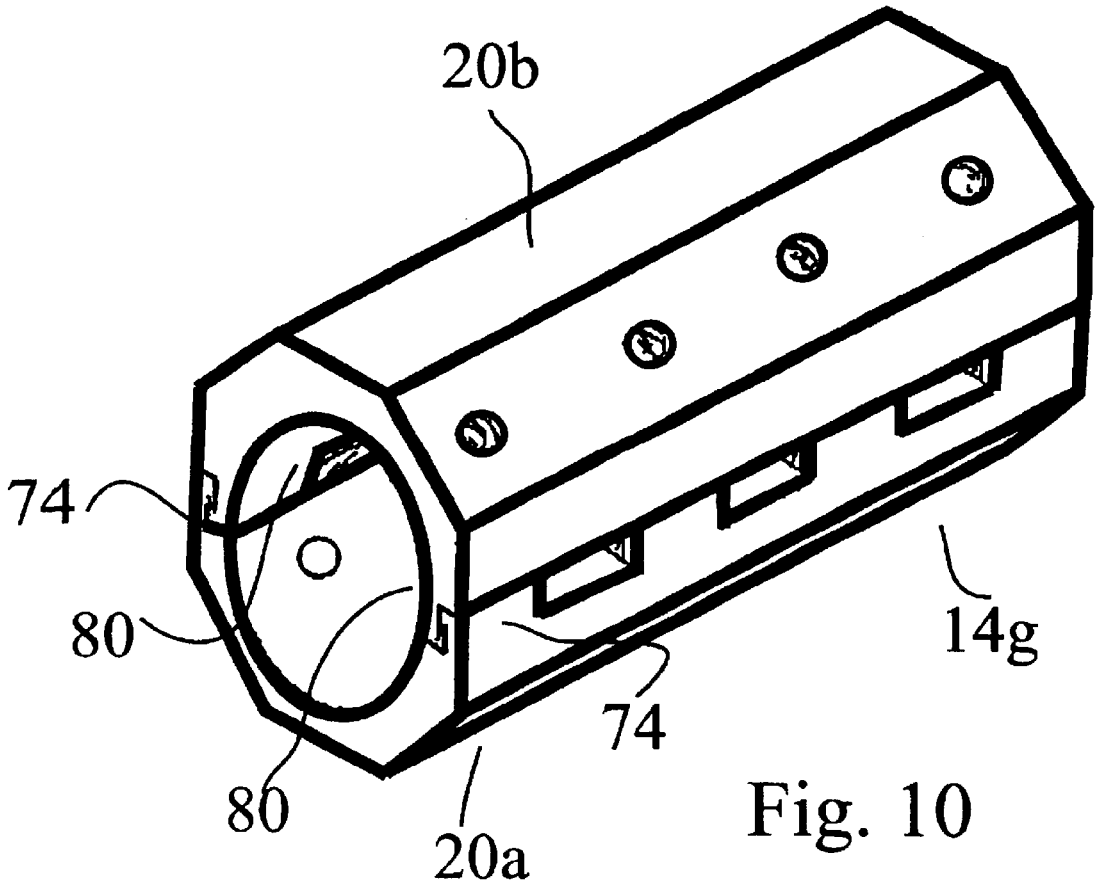
FIG. 10 is a perspective view showing two interlocking portions of the two-part grip of FIG. 9 locked together.

FIGS. 9 and 10 show yet another embodiment of the two-part grip portion, generally designated 14*g*, that is utilizes a slip fit connection mechanism connecting the two grip portions 20*a*, 20*b*. This embodiment is usable between two confining or interfering structures such as the risers on either side of a ladder rung or the weights or collars on either side of dumbbell. Grip portion half 20*a* has multiple pairs of spaced apart, inwardly curved connecting structures 74, each separated by a gap 76 from adjacent connecting structures 74. Grip portion half 20*b* has multiple pairs of spaced apart, outwardly curved connecting structures 80, each separated by a gap 82 from adjacent connecting structures 80.

Grip portion halves 20*a*, 20*b* are secured together by first aligning the connecting structures 80 with gaps 76. The two halves 20*a*, 20*b* are then axially moved in opposite directions until the connecting structures 74 are in aligned engagement with one another.

Figure 11:
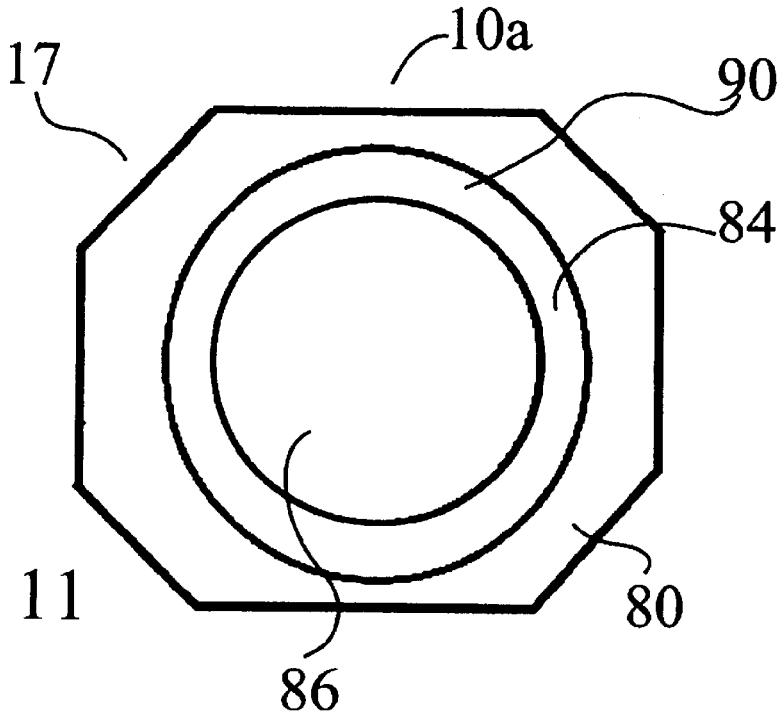
FIG. 11 is a cross sectional view of a one-piece, extruded plastic grip with a handle permanently secured in the grip portion by an adhesive.

FIG. 11 is cross sectional view of yet another exemplary embodiment of the ergonomic grip assembly 10*a*. Int his embodiment, the two-part grip portion 14 is replaced by a single extruded one-piece or integral grip portion 80. The extruded plastic grip portion 80 has the same outer surface configuration 17 as described with reference to previous figures. Grip assembly 10*a* also differs from grip assembly 10 in that in place of multiple screws and drilled and tapped bores as the mechanical securing mechanism, grip assembly 10*a* utilizes an adhesive such as an epoxy glue 84 to secure an article 86 permanently within article section receiving passageway 90.

Figure 13:
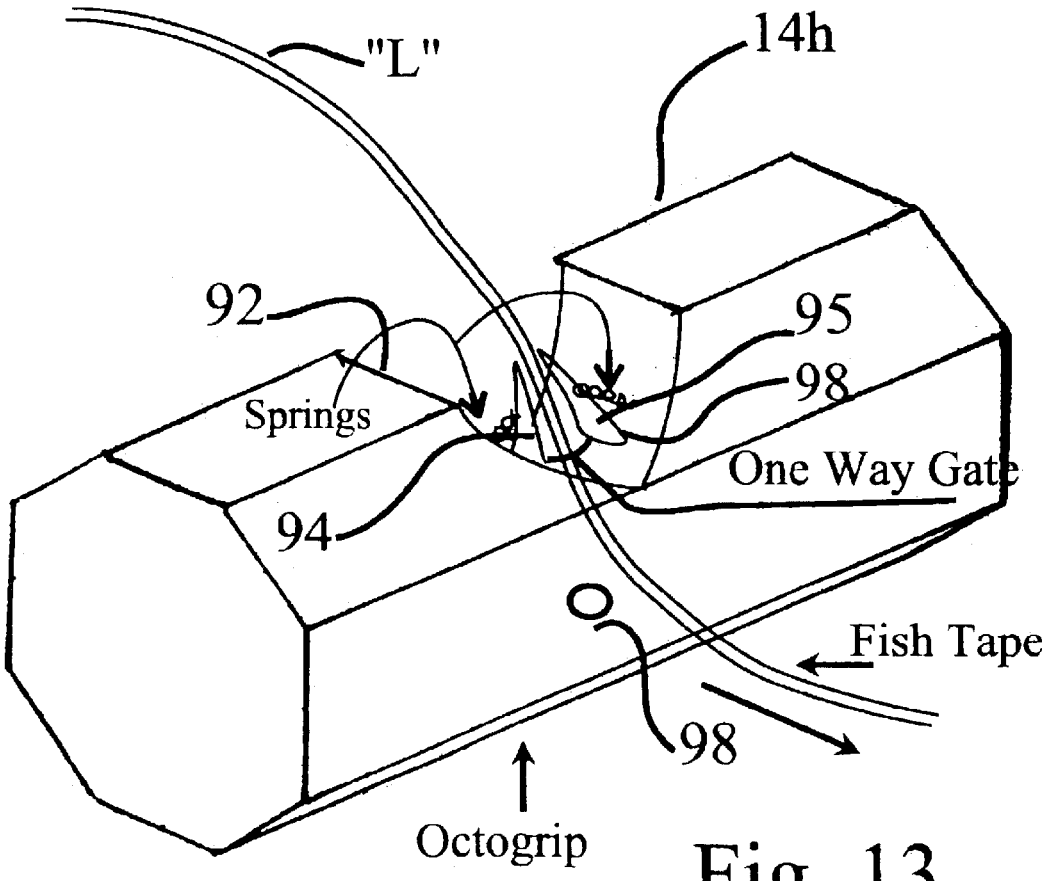
FIG. 13 shows yet another embodiment of the grip used to pull a line, wire or fish tape.

In FIG. 13, the grip assembly 14*h* is shown as having a one piece solid body with a recess 92 at an intermediate location. A pair of pivotal, spring-loaded jaws 94, 95 are located in the recess so that a line, wire or fish tape "L" can be threaded between the jaws. The user will grasp the body of the group and may exert a substantial pulling force in the direction of the arrow without damaging the line or tape. The jaws will prevent the line "L" from slipping and has particular application to pulling fish tapes through tight or confined areas. The line may be released by opening the jaws by applying a manual force to the jaws' ends 98. The grip may also be provided with a through bore 98 through which a line may be passed and tied off on the opposite side. An example of use is the pull starter on a small engine such as a lawnmower.

It is noted that the embodiment of the grip assembly attachable to variously shaped article sections described herein in detail for exemplary purposes is subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A tool grip securable about the exterior of various shaped articles for application of force to the article comprising:

(a) a rigid body with opposite ends having an ergonomically shaped outer surface being polygonal in cross section having a plurality of planar surfaces each having a width and length with two of the opposed surfaces having a greater width than the remaining surfaces, said remaining surface all having substantially the same width, said body defining an article receiving passageway; and (b) article attaching means for securing said body to said article.

2. The grip of claim 1 wherein said body is generally elongate and comprises two sections each having longitudinal extending edges.

3. The grip of claim 1 wherein said article attaching means comprises a mechanical fastener.

4. The grip of claim 1 wherein said body tapers from one end to the other.

5. The grip of claim 1 wherein said body is an integral one piece member.

6. The grip of claim 1 wherein said attaching means comprises an adhesive.

7. The grip of claim 1 wherein said body is octagonal.

8. The grip of claim 1 wherein said body is fabricated from the group of materials consisting of metal, rigid plastic and hard rubber.

9. The grip of claim 1 wherein the grip is integrally formed as a component of a tool.

10. A grip securable about the exterior of various shaped articles to apply a manual force to the articles comprising:

(a) a rigid body having opposite ends having an ergonomically shaped outer gripping surface, said gripping surface being polygonal in cross section having a plurality of longitudinally extending surfaces each having a width and a length;

(b) two of said opposed surfaces having a greater width than the remaining surfaces, said remaining surfaces all having substantially the same width and length;

(c) said body being formed in two sections, each section having a pair of opposed longitudinal edges having projections which when assembled define an article receiving passageway, said projections interlocking to transfer applied force to the other section; and (d) article attaching means for securing said body to an article.

11. The grip of claim 10 wherein said sections are hinged at edges.

12. The grip of claim 10 wherein said article attachment means comprises a pair of jaws on the body of the grip engageable with a line whereby the grip may be used to exert a pulling force on said line.

* * * * *